United States Patent [19]

Magera

[11] 4,225,307

[45] Sep. 30, 1980

[54] REFRACTORY INSULATION FOR SKID PIPES AND THE LIKE IN REHEATING FURNACES

[76] Inventor: Matthias R. Magera, 461 Fair Dr. #102, Costa Mesa, Calif. 92626

[21] Appl. No.: 41,985

[22] Filed: Jun. 29, 1979

[51] Int. Cl.³ ..... F27D 3/02

[52] U.S. Cl. ..... 432/234; 138/147; 138/174

[58] Field of Search ..... 432/233, 234; 138/147, 138/174

[56] References Cited

U.S. PATENT DOCUMENTS

| | | | |
|---|---|---|---|
| 2,693,352 | 11/1954 | Bloom | 432/234 |
| 3,030,250 | 4/1962 | Losse | 138/147 |
| 3,804,585 | 4/1974 | Twort | 432/234 |
| 4,134,721 | 1/1979 | Davis et al. | 432/234 |

FOREIGN PATENT DOCUMENTS

| | | | |
|---|---|---|---|
| 1220685 | 7/1966 | Fed. Rep. of Germany | 138/147 |

*Primary Examiner*—John J. Camby

*Attorney, Agent, or Firm*—William J. Ruano

[57] ABSTRACT

Skid pipe insulation for water cooled support piping in a reheating furnace comprising refractory semicircular complementary sleeves having wire reinforcement embedded in the sleeve refractory material and wherein the wire may be prestretched and located on the inner surface of the refractory insulation to directly contact, metal-to-metal, the outer surface of the cooling pipe. The reinforcing reticulations of the wire are at an angle to the longitudinal axis of the refractory sleeve. Identical semi-circular portions are provided with interconnecting anchoring studs and eyes to reduce inventory and to enable stressing of the wire reinforcement simply by turning nuts of J-bolts, eliminating the requirement for welding of the reinforcing wire to the pipe. Longitudinal shoulders on the refractory protect the bolts from the effect of heat of the slab. The construction is such that tightening of the bolts and stressing of the reinforcing wire will cause no relative movement between the wire and refractory insulation.

11 Claims, 7 Drawing Figures

REFRACTORY INSULATION FOR SKID PIPES AND THE LIKE IN REHEATING FURNACES

This invention relates to a reinforced refractory pipe insulating structure for use in reheating furnaces for heating metal billets and the like. It is useful for skid rails as well as cross overs and risers associated with the skid rails.

An outstanding disadvantage of formerly used reinforced pipe insulation for skid rails and the like in the prior art, as exemplfied U.S. Pat. No. 2,693,352 of Nov. 2, 1954, is that the reinforcing wire must be welded to the pipe. This requires a welder to be on the job with welding equipment and material with expensive welding operations to be performed. Moreover, the internal structure of the reinforcement is not adequately protected from the effects of the heat provided by the moving hot slab on the skid rail.

Still another disadvantage of insulating devices of this kind is that the inventory requirement is very expensive since the two halves of the pipe insulation are not identical for complementary use, therefore requiring inventory of two different constructions of the semicircular portions.

Still another disadvantage is that the reinforcing wire is of such construction as to become easily loosened, if it is embedded centrally of the insulation, because the vibration accompanying the slab movement will effect relative movement between the reinforcing wire and insulation and cause rupturing of the insulation and breakdown of the insulating sleeve.

An object of my invention is to overcome the above named disadvantages of prior used reinforced refractory pipe insulation for skid rails and the like.

A more specific object of the invention is to provide a refractory reinforcement that is prestressed and that is partially exposed to the inner surface of the sleeve so as to make a direct metal-to-metal contact with the cold water circulating pipe so as to effectively cool the metal mesh and so as to avoid any relative movement of the refractory or mesh and the chain-like reinforcement.

Other objects and advantages of the invention will become more apparent from a study of the following description taken with the accompanying drawings wherein.

Figure 1:
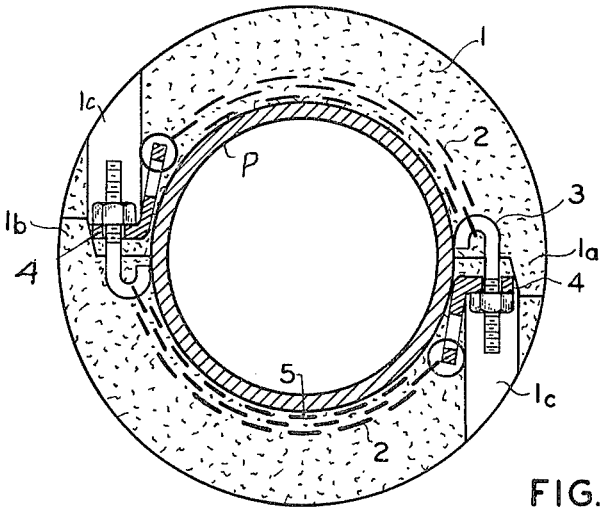
FIG. 1 is a cross-sectional view of the refractory sleeve embodying the present invention.
Figure 2:
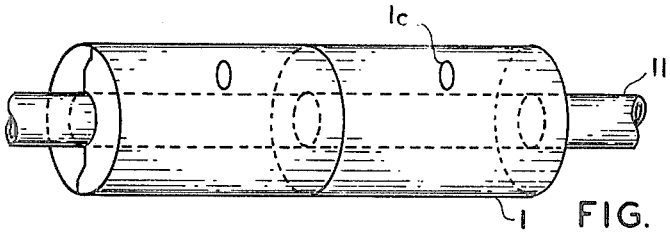
FIG. 2 is a perspective view of two identical end-to-end units for a cross-over.

Referring more particularly to FIG. 1, numeral 1 denotes a semi-circular high alumina refractory sleeve embodying the present invention. It may be of any composition for resisting extremely high temperatures, such as temperatures of the order of 270 degrees F. For example, the composition may be of 80% alumina, 10% calcium oxide, 5% titanium and the remainder iron oxide and impurities. Numeral 3 denotes a J-bolt which is embedded refractory 1. The shank is anchored by an eye 4 of bent wire in a portion of mesh 2. The thread portion thereof projects outwardly through a slot 1C formed in the refractory. The curved portion of the J-bolt hooks into one of the links of a stainless steel anchoring mesh 2 which extends throughout the entire length of the refractory material.

It will be further noted that the reticulations of the mesh or wire are disposed at an angle relative to the longitudinal direction. Thus upon screwing the nut onto the threaded portion of two bolts, when two complementary halves of the sleeve are placed about the water conducting pipe P, the chain or mesh will be effectively stretched throughout its entire length. It will be especially noted that the mesh or wire which may be of No. 314 grade stainless steel chain, similar in shape to the Cyclone fence type of chain which also runs at an angle, that portions of the chain protrude through the insulation so as to make a metal-to-metal contact with the pipe contained inside the sleeve, which pipe circulates cooling water. Thus the cooling effect of the water will be quickly transmitted to the highly heat conductive chain into the interior of the refractory sleeve to keep it from overheating.

Another important feature of the invention is the protective projections 1A and 1B of the insulating sleeve which fully protect and prevent entry of heat so as to not directly expose the J-bolt to the effects of high temperatures of the slab.

Still another very important feature is that the two halves of the sleeve are exactly identical in construction. Therefore, only one semi-circular construction need to be kept in inventory, eliminating the necessity of having different constructions for the respective halves. A connecting eye 4 of the mesh is exposed at one end and the threaded shank of the J-bolt at the other end of each half.

In operation, when it is desired to mount the insulating sleeve on the water cooled pipe, the two halves are brought together and nuts are introduced into the slots 1*a* so as to tighten the J-bolt 3 and apply tension to the reinforcing mesh. Such tension does not effect relative movement between the mesh and insulation since the mesh is already disposed in direct metallic contact with the pipe. Thus the construction described is particularly suitable for cross overs and risers since a 360 degree covering is provided and it is less useful for skids which do not have tracks welded thereto, that is skids on thicker exposed dimensions of the pipe.

Figure 3:
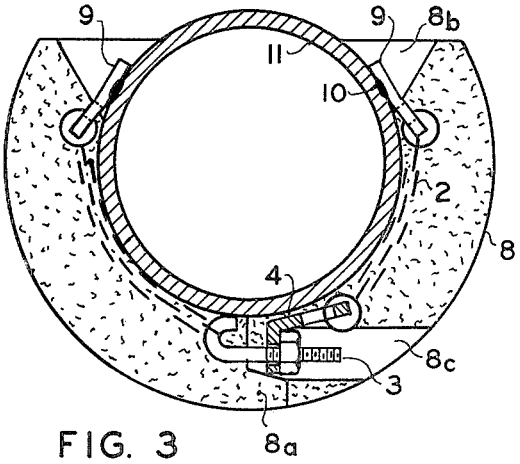
FIG. 3 is a modification of the sleeve shown in cross-section for a skid.
Figure 4:
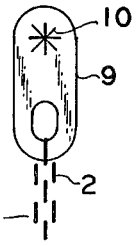
FIG. 4 is a plan view of one of the supporting brackets in FIG. 3.

FIGS. 3 and 4 show a modification which is particularly suitable for a skid either with or without a track integrally formed on the top portion. The important provision being that the insulation must cover less than 360°. Stainless steel brackets 9 are welded at 10 to the pipe 11 and the mesh or chain 2 is hooked thereon. Only a single J-bolt construction 3 is shown since the insulation covers only 270° in order to provide an exposed top surface for the skid to slidably support the heated slab.

The chain or mesh is preferably angularly disposed relatively to the longitudinal direction in order to uniformly spread the stress throughout upon tightening the nut onto the J-bolt. If desired, a rail or skid may be welded to the uppermost portion of the exposed part of the pipe in order to serve as a track for the heated slabs. A plurality of sleeves may be arranged, end-to-end, to cover any length of water cooled pipe.

Figure 5:
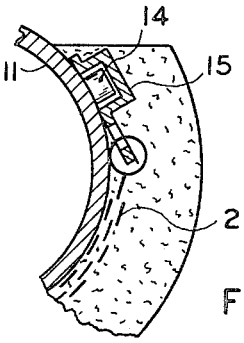
FIG. 5 is a further modification, shown in cross-section.

FIG. 5 shows a further modification wherein studs 14 are welded to the water pipe and brackets 15 are fastened thereto and are attached to the stainless steel mesh. The insulation covers an arc of 270° and normally a single J-bolt and nut is required in order to effect prestressing and assembly of the insulation on the water cooled pipe.

Figure 7:
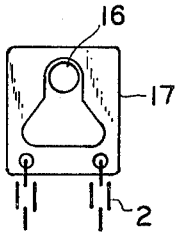
FIG. 7 is a side view taken along line VII—VII of FIG. 6.
Figure 6:
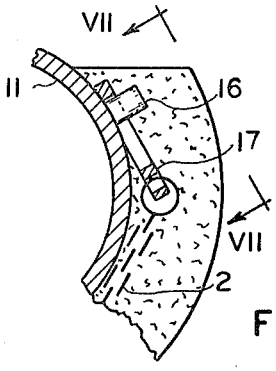
FIG. 6 is a still further modification, in cross-section.

The above described bracket, as shown in FIGS. 6 and 7, may be simply a key hole slot formed into the bracket 17 with the pin 16 welded to the pipe extending into the small hole of the slot. Holes can be made in the bracket through which chain or reinforcng mesh 2 is passed. By the present construction slightly different sizes of pipe may be used since the bracket construction will take up for any differences in diameter. The present construction is particularly suitable for skids since the exposed part of the pipe may serve as a track on which the heated slab slides.

Thus it will be seen that I have provided a highly efficient insulating sleeve for effectively insulating a water cooled pipe, such as used in various parts of the supporting structure of a reheating furnace; furthermore, I have provided a refractory sleeve that requires no welding of its reinforcing wire or mesh to the pipe on which it is mounted; furthermore by exposing the mesh or wire to the interior surface of the insulation, metal contact may be made between the wire and the pipe for effective cooling the metal mesh and another very important feature from such construction is that the mesh may be prestressed and it may be further stretched by tightening the nut, therefore the stretching will not move the reinforcement radially inwardly of the insulation and fracture the insulation as often occurs in operation; furthermore, I have provided a construction which reduces the inventory needed for parts by one half and greatly reduces costs of manufacture. By the present construction a single half sleeve construction is all that is required to be manufactured since the halves are identical and complementary in every respect; furthermore, I have provided a construction wherein the lip or projection formed at the joint between the complementary portions of the sleeve are such as to provide an effective barrier to prevent entrance of heat from the heated slab or from slag resulting therefrom, therefore preventing the J-bolt from being burnt, destroyed or oxidized from such heat; furthermore, I have provided effective 270° insulation sleeve which also has the advantages of the full 360° sleeve described and which is suitable for long skids and the like, such construction requiring only two points of welding or two points at which a pin is welded, the remainder being free of any welding.

While I have illustrated and described several embodiments of my invention, it will be understood that these are by way of illustration only and that various changes and modifications may be contemplated within the scope of the following claims.

I claim:

1. For use for heat insulating a fluid flowing cooling pipe in a furnace, a pair of arcuate, pre-fabricated sleeve portions of refractory material, a metallic mesh embedded along the length of the inner surfaces of said sleeve portions and having parts thereof exposed and projecting beyond the inner surface of said refractory material so as to provide metallic contact with said pipe, a J bolt hooked onto one end of said metallic mesh of one sleeve portion and embedded in said refractory material except for a threaded shank portion extending beyond said one end, an eye having an integral support embedded in one end of an adjacent sleeve portion and arranged so that said threaded shank extends through said eye, a hole in said one end of the adjacent sleeve portion, a nut projecting into said hole and screw threaded to said exposed shank to tightly hold together the adjacent ends of said meshes of adjoining sleeve portions, terminal means connected to the other ends of said meshes, and means for rigidly holding together said terminal means so that said adjacent sleeve portions at least partially surround said pipe.

2. The sleeve portions recited in claim 1 wherein said meshes are prestressed.

3. The sleeve portions recited in claim 1 wherein said one end of one sleeve portion has a circumferential extending shoulder to shield a portion of said threaded portion of said J bolt from a direct radially inward flow of heat.

4. The sleeve portions recited in claim 1 wherein said sleeve portions extend approximately 180° about said pipe.

5. The sleeve portions recited in claim 1 wherein said sleeve portions extend approximately 270° about said pipe and wherein said terminal means are connected direcly to said pipe.

6. The sleeve portions recited in claim 5 wherein said terminal means are welded directly to said pipe.

7. The sleeve portions recited in claim 6 wherein each of said terminal means includes a pin welded to said pipe and a bracket having an opening fitted to said pin.

8. The sleeve portions recited in claim 5 wherein said means for rigidly holding together said terminal means comprise brackets projecting from the ends of said sleeve portions and welded to said pipe.

9. For use in combination with a water flowing pipe, an insulating sleeve of semi-circular cross section of a construction so as to mate completely with an identical semi-circular sleeve, said sleeves surrounding said pipe, each semi-circular sleeve comprising a J-bolt embedded in each sleeve and having a threaded shank projecting from one end portion, an eye for receiving said shank projecting from the other end portion of each sleeve for holding said sleeves together, a stainless steel mesh embedded in said sleeve and hooked onto the J-bolt at one end and to said eye at the other end and extending about the inner circumference of the sleeve exposed through the insulating sleeve so as to make direct metal contact with the pipe, and a slot formed in the end portion of each semi-circular sleeve through which the threads of said J-bolt and eye extend, and a nut threaded to each threaded shank.

10. The sleeve recited in claim 9 wherein said anchoring mesh is prestressed.

11. The sleeve recited in claim 9 wherein an outward, circumferential projection is provided at the end of each semi-circular portion to prevent a direct radially inward path for heat flow to the pipe.

* * * * *